US009214748B2

(12) United States Patent
Chen

(10) Patent No.: US 9,214,748 B2
(45) Date of Patent: Dec. 15, 2015

(54) BOARD TO BOARD CONNECTOR PREVENTING AN INSULATIVE HOUSING FROM WARPING DURING ASSEMBLING A PLURALITY OF CONTACTS INTO THE INSULATIVE HOUSING

(71) Applicant: HON HAI PRECISION INDUSTRY CO., LTD., New Taipei (TW)

(72) Inventor: Ming-Ching Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/263,006

(22) Filed: Apr. 28, 2014

(65) Prior Publication Data

US 2014/0322962 A1 Oct. 30, 2014

(30) Foreign Application Priority Data

Apr. 26, 2013 (TW) ..... 102207642 U

(51) Int. Cl.
*H01R 13/00* (2006.01)
*H01R 12/71* (2011.01)

(52) U.S. Cl.
CPC ..... *H01R 12/716* (2013.01); *Y10T 29/49147* (2015.01)

(58) Field of Classification Search
CPC ..... H01R 23/725; H01R 23/4006
USPC ..... 439/74, 485
See application file for complete search history.

(56) References Cited

U.S. PATENT DOCUMENTS

| | | | | |
|---|---|---|---|---|
| 6,793,506 | B1 | 9/2004 | Hirata et al. | |
| 7,275,966 | B2 * | 10/2007 | Poh et al. | 439/636 |
| 7,278,861 | B2 * | 10/2007 | Kishi et al. | 439/74 |
| 7,425,158 | B2 * | 9/2008 | Ookura | 439/660 |
| 7,465,171 | B2 | 12/2008 | Miyazaki et al. | |
| 7,845,987 | B2 * | 12/2010 | Yamada et al. | 439/680 |
| 8,109,771 | B2 | 2/2012 | Chen | |
| 8,465,298 | B2 * | 6/2013 | Takeuchi et al. | 439/74 |
| 2006/0178022 | A1 * | 8/2006 | Liu | 439/74 |
| 2007/0141866 | A1 * | 6/2007 | Kishi et al. | 439/74 |
| 2010/0081330 | A1 * | 4/2010 | Wu et al. | 439/626 |

* cited by examiner

*Primary Examiner* — Hae Moon Hyeon
(74) *Attorney, Agent, or Firm* — Ming Chieh Chang; Wei Te Chung

(57) ABSTRACT

A board to board connector (100) includes an insulative housing (1) and a number of contacts (2) assembled in the insulative housing. The insulative housing has a first face (11), a second face (12) opposite to the first face, a pair of longitudinal vertical walls (13) connecting between the first face and the second face, a pair of transverse vertical walls (14) connecting between the first face, the second face and the longitudinal vertical walls, and a number of protrusions (131) protruding from the longitudinal vertical walls to be planar with the first face. The contacts are assembled in the insulative housing from the second face to the first face.

4 Claims, 4 Drawing Sheets

BOARD TO BOARD CONNECTOR PREVENTING AN INSULATIVE HOUSING FROM WARPING DURING ASSEMBLING A PLURALITY OF CONTACTS INTO THE INSULATIVE HOUSING

BACKGROUND OF THE INVENTION

1. Field of the Invention

The present invention relates generally to a board to board connector, and more particularly to a board to board connector having protrusions for preventing an insulative housing from warping during assembling a plurality of contacts into the insulative housing.

2. Description of Related Arts

U.S. Pat. No. 7,465,171 discloses a board to board connector including an insulative housing and a plurality of contacts retained in the insulative housing. The insulative housing has a pair of longitudinal arms and a pair of transverse arms connecting between the longitudinal arms to form a receiving channel. The longintudinal arms are leveled lower than the transverse arms at an upper side of the insulative housing. Because the contacts are assembled into the passageways from a lower side of the insulative housing, the insulative housing is inverted for the purpose of assembling the contacts. Since only the transverse arms are supported on a tooling table or the like, the longtitudinal arms are spaced away from the tooling table without support. Therefore, the transverse arms undertake large i force during inserting the contacts.

U.S. Pat. No. 8,109,771 discloses a board to board connector including an insulative housing and a plurality of contacts retained in the insulative housing. The insulative housing has a receiving space for accommodating a mating connector and a mating tongue protruding upwardly from the receiving space. The mating tongue defines a plurality of passageways on two opposite sides thereof The contacts are assembled into the passageways from an upper side of the mating tongue. The mating tongue forms a plurality of protrusions on the upper side of the mating tongue. An assembling direction of the contacts relative to the insulative housing (from top to bottom) is opposite to a protruding direction of the protrusions (from bottom to top). Therefore, the protrusions do not provide support for the insulative housing when the contacts are assembled into the insulative housing.

U.S. Pat. No. 6,793,506, issued to Hirata et al. on Sep. 21, 2004, discloses a plug connector having a pair of elongated housing portions and projecting posts formed integrally with housing. Plug contacts are bottom loaded into the elongated housing portion. Protrusion like structures are formed on an upper surface of the housing portion between every two adjacent plug contacts. The protrusions extend short of the projecting posts.

SUMMARY OF THE INVENTION

Accordingly, an object of the present invention is to provide a board to board connector preventing an insulative housing from warping during assembling a plurality of contacts into the insulative housing.

To achieve the above object, a board to board connector includes an insulative housing and a plurality of contacts assembled in the insulative housing. The insulative housing has a first face, a second face opposite to the first face, a pair of longitudinal vertical walls connecting between the first face and the second face, a pair of transverse vertical walls connecting between the first face, the second face and the longitudinal vertical walls, and a plurality of protrusions protruding from the longitudinal vertical walls to be leveled with the first face. The contacts are assembled in the insulative housing from the second face to first face.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Referring to FIGS. 1-4, a board to board connector 100 of the present invention comprises an insulative housing 1 and a plurality of contacts 2 retained in the insulative housing 1.

Figure 1:
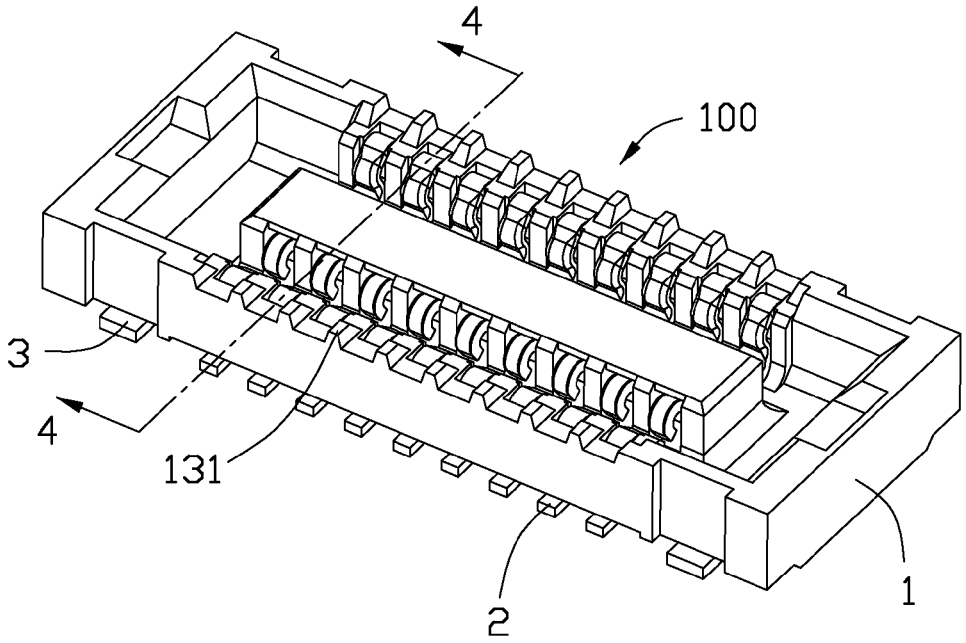
FIG. 1 is a perspective, assembled view of a board to board connector constructed in accordance with the present invention.
Figure 2:
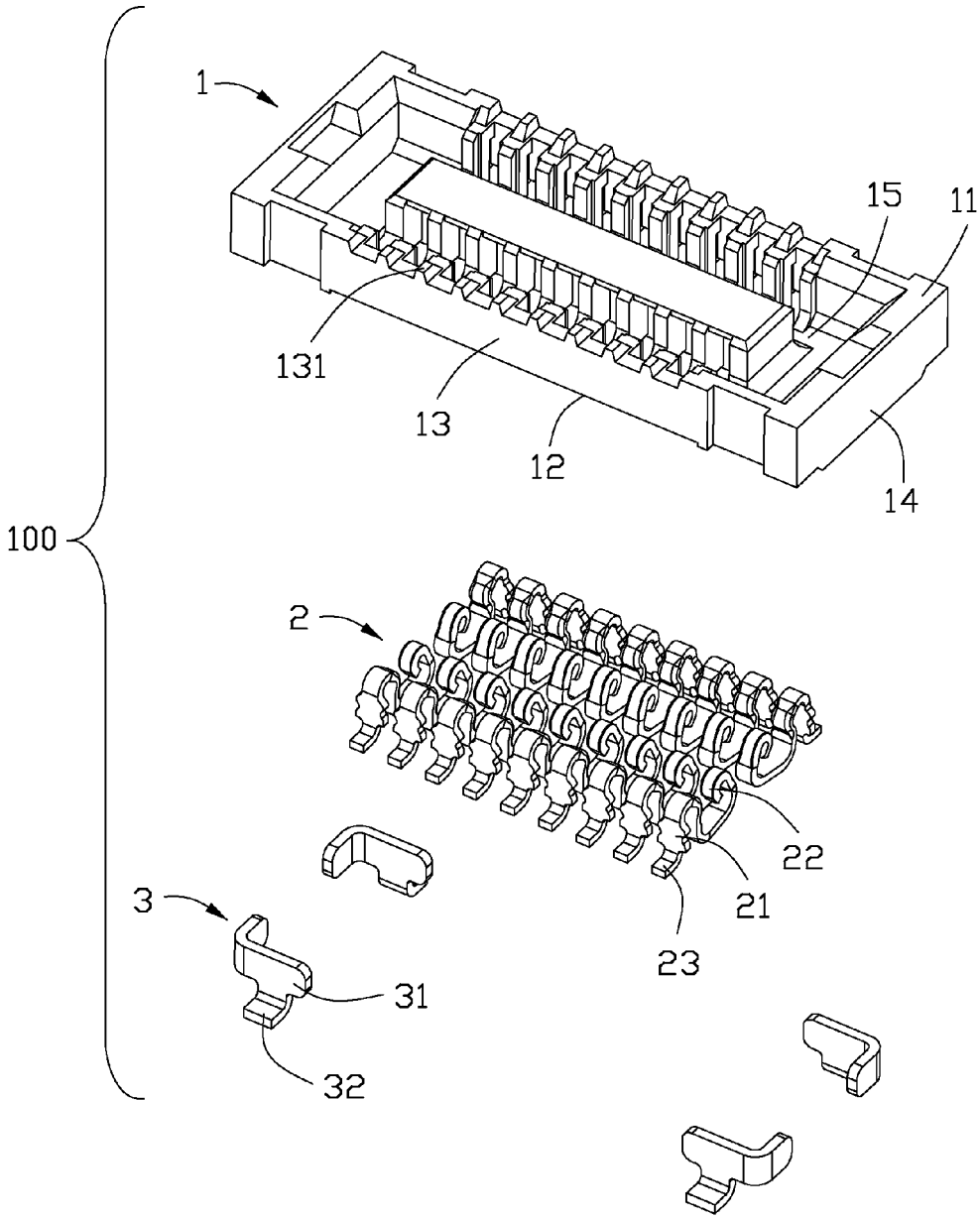
FIG. 2 is a perspective, exploded view of the board to board connector.

Referring to FIGS. 1 and 2, the insulative housing 1 comprises an upper face 11 for abutting with a mating connector (not shown), a lower face 12 for assembling on a printed circuit board (not shown), a pair of longitudinal vertical walls 13 connecting between the upper face 11 and the lower face 12, and a pair of transverse vertical walls 14 connecting between the upper face 11, the lower face 12, and the longitudinal vertical walls 13. The longitudinal vertical walls 13 are generally leveled with the lower face 12 but are slightly lower than the upper face 11. The insulative housing 1 has a plurality of protrusions 131 extending upwardly from the longitudinal vertical walls 13 to be coplanar with the upper face 11. Therefore, the protrusions 131 are positioned in two parallel lines. Every two adjacent protrusions 131 in a same line are spaced with each other at a same distance. Every two opposing protrusions 131 define a first transverse line and the opposing contacts 2 define a second transverse line which is offset away from the first transverse line. The longitudinal vertical walls 13 and the transverse vertical walls 14 cooperatively define a receiving space 15 for accommodating the mating connector.

Figure 3:
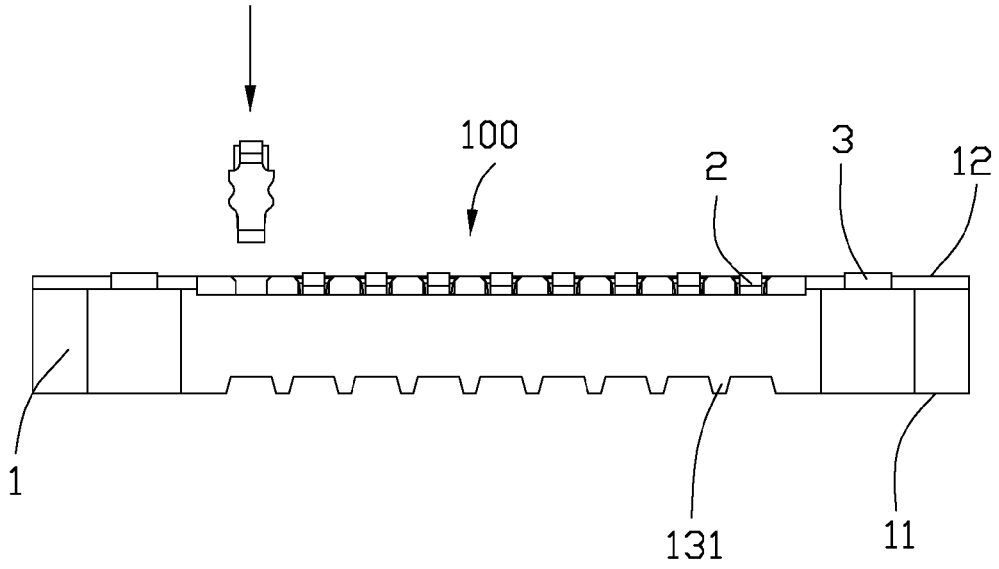
FIG. 3 is a front elevational view of a contact pre-assembled into an insulative housing of the board to board connector.
Figure 4:
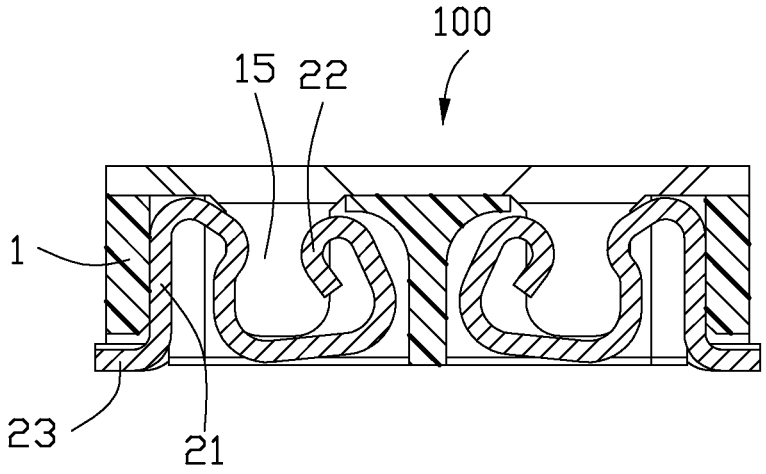
FIG. 4 is a cross-sectional view taken along line 4-4 of FIG. 1.

Referring to FIGS. 2 and 3, each contact 2 comprises a retaining portion 21 retained in the longitudinal vertical wall 13, an elastic contact portion 22 curvedly extending from a first end of the retaining portion 21, and a soldering portion 23 vertically extending from a second end of the retaining portion 21. The elastic contact portion 22 is exposed into the receiving space 15 for connecting with the mating connector. The soldering portion 23 extends out of the longitudinal vertical wall 13 of the insulative housing 1 for soldering on the printed circuit board.

Referring to FIG. 3, in assembling, the insulative housing 1 is inverted on a tooling or working table (not shown) or the like, because the upper face 11 and the protrusions 131 are both supported on the table, and because the contacts 2 are assembled in the insulative housing 1 along a direction in accordance with a protruding direction of the protrusions 131, the protrusions 131 provide supporting force for the insulative housing 1 when the contacts 2 are assembled into the corresponding passageways (not labeled) of the insulative housing 1. In the present embodiment, the contacts 2 are assembled in the insulative housing 1 from the lower face 12 toward the upper face 11, and the protrusions 131 project upwardly from the dividing walls (not labeled) each between the two neighboring passageways (not labeled) of the longitudinal vertical walls 13 toward the upper face 11. Therefore, the insulative housing 1 is prevented from warping during assembling the contacts 2 therein. In this embodiment, a notch (not labeled) is formed between every adjacent two protrusions 131 for heat dissipation in the transverse direction. On the other hand, the protrusion 131 is dimensioned short than the corresponding dividing wall in the transverse direction for heat dissipation in the longitudinal direction.

In an alternative embodiment, the contacts 2 are assembled in the insulative housing 1 from the upper face 11 toward the lower face 12 and the protrusions 131 project downwardly from the longitudinal vertical walls 13 towards the lower face 12, the contacts 2 are assembled in the insulative housing 1 along a direction in accordance with a protruding direction of the protrusions 131, too. The longitudinal vertical walls 13 are planar with the upper face 11 but higher than the lower face 12. The protrusions 131 are coplanar with the lower face 12 and therefore provide supporting force for the insulative housing 1 when the contacts 2 are assembled in the insulative housing 1. The insulative housing 1 is thus prevented from warping during assembling the contacts 2 therein.

In the preferred embodiment, the board to board connector 100 of the present invention has four board locks 3. Each board lock 3 has a base portion 31 secured in the insulative housing 1 and a soldering pad 32 bending from the base portion 31 for soldering on the printed circuit board.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A board to board connector comprising:

an insulative housing including a pair of longitudinal walls in a longitudinal direction, and a pair of transverse walls in a transverse direction perpendicular to said longitudinal direction, to commonly define a receiving space, each of said longitudinal walls forming a complete and continuous exterior surface along said longitudinal direction;

a plurality of passageways formed in the longitudinal walls;

a plurality of dividing walls formed between the neighboring passageways, respectively;

a plurality of protrusions formed on top ends of the corresponding dividing walls, respectively;

a plurality of contacts each including a surface mounting tail and configured to be upwardly inserted into the corresponding passageway with the corresponding surface mounting tail under the longitudinal wall;

wherein a plurality of notches are formed between the corresponding neighboring protrusions, respectively, for heat dissipation in the transverse direction; wherein each of said protrusions is terminated at an exterior surface of the corresponding longitudinal wall and dimensioned shorter than the corresponding dividing wall in the transverse direction for heat dissipation proximate the receiving space along the longitudinal direction.

2. The board to board connector as claimed in claim 1, wherein an upper end region of each of said contacts is located lower than the corresponding neighboring notch and hidden behind the exterior surface of the longitudinal wall in said transverse direction.

3. The board to board connector as claimed in claim 2, wherein the housing includes in said longitudinal direction two opposite end portions with top faces coplanar with those of said protrusions.

4. The board to board connector as claimed in claim 1, wherein each of said notches is free from the corresponding neighboring contact.

* * * * *